United States Patent [19]

Benincasa et al.

[11] 4,193,367

[45] Mar. 18, 1980

[54] BOAT DESIGNED TO WITHSTAND THE FORCE OF UNDERWATER EXPLOSIONS

[75] Inventors: John J. Benincasa, Rockville; Marvin L. Hage, Avon, both of Conn.

[73] Assignee: United Technologies Corporation, Hartford, Conn.

[21] Appl. No.: 816,934

[22] Filed: Apr. 17, 1969

[51] Int. Cl.[2] ..... B63B 43/18; B63B 43/00

[52] U.S. Cl. ..... 114/68

[58] Field of Search ..... 114/65, 66, 68, 84, 114/65.1; 244/126

[56] References Cited

U.S. PATENT DOCUMENTS

| | | | |
|---|---|---|---|
| 1,310,233 | 7/1919 | Armstrong | 114/68 |
| 1,390,745 | 9/1921 | Armstrong | 244/126 |
| 1,528,122 | 3/1925 | Macmechen | 244/126 |
| 1,642,026 | 9/1927 | Hürttle | 244/126 |
| 1,852,493 | 4/1932 | Tobias | 114/68 X |
| 2,455,593 | 12/1948 | Loewenstein | 114/84 |

*Primary Examiner*—Stephen C. Bentley
*Assistant Examiner*—Thomas H. Webb
*Attorney, Agent, or Firm*—Vernon F. Hauschild

[57] ABSTRACT

A marine vessel whose hull consists of a single skin bottom plating comprising a plurality of large area membrane members supported by structural members about their outer periphery only and being of low areal density so as to deflect rapidly and substantially in response to the force of the shock wave of an underwater explosion without permanent deformation and whose personnel and machinery compartments are supported from hull structural members, such as bulkheads, solely by shock absorbing mounts.

17 Claims, 13 Drawing Figures

LIGHT PLATE (FRP) (MEMBRANE)
HEAVY PLATE (STEEL)
FREE WATER PRESSURE
TIME
OVERPRESSURE
2Po
Po

BOAT DESIGNED TO WITHSTAND THE FORCE OF UNDERWATER EXPLOSIONS

CROSS-REFERENCE TO RELATED APPLICATIONS

There are no related copending applications.

BACKGROUND OF THE INVENTION

1. Field of Invention

This invention relates to the field of marine vessels and particularly to a vessel construction which is capable of withstanding the force of an underwater explosion without sustaining structural damage or damage to personnel and sensitive machinery.

2. Description of the Prior Art

In the hull structure art designed to absorb the force of underwater explosions, armament type equipment has been carried externally of the hull for this purpose. For example, in Almengual U.S. Pat. No. 1,236,033, a series of chains and springs, and possibly rubber, are mounted external of the hull to absorb forces which would otherwise damage the hull proper. In Pagenstecher U.S. Pat. No. 43,377, a plurality of rubber bags which are filled with water surround the vessel hull to absorb explosive forces. Brown U.S. Pat. No. 2,969,036 teaches the use of a liquid filled flexible outer skin external of the hull to absorb the impact of underwater explosions. It will be noted that in this type of prior art, additional armament or equipment is carried external of the vessel's hull to absorb the force of underwater explosions and other forces which would otherwise potentially damage the vessel's rigid hull. This extra equipment, including the chains, the water bags and the like, is extremely heavy and adversely affects the hydrodynamic characteristics of the vessel, its speed potential and its maneuverability potential and therefore is undesirable.

To overcome these disadvantages, it has been conventional practice to fabricate ship hulls of very heavy, relatively inflexible, thick, metal plate material. These thick plate members are capable of partially absorbing the force of an underwater explosion by absorbing the energy thereof through a bending process, however, this extraordinarily thick plate hull construction, which is necessary to absorb the energy of underwater explosion, is untenable from a weight standpoint in that the speed capability and maneuvering capability of the vessel are adversely affected thereby.

SUMMARY OF THE INVENTION

A primary object of the present invention is to provide a vessel whose hull is serviceable from a hydrodynamic standpoint, which is not only capable of withstanding the forces of underwater explosions but which is capable of absorbing or attentuating the forces of underwater explosions, and which is capable of withstanding any type of debris collision which would be encountered in normal operation and, further, to protect the crew and sensitive instruments and machinery from any force which is not absorbed or attenuated by the hull.

In accordance with the present invention, the bottom portion of the hull is fabricated like a drum or balloon skin and consists of a plurality of membrane members of large area and low areal density which are supported about their periphery only and which are of selected thickness and material so as to respond to the shock wave of an underwater explosion by rapidly deflecting substantially so as not only to absorb the energy of the shock wave through deflection and tensile loading without bending loading but also to create cavitation of the water adjacent the hull due to the rapid deflection thereof, which cavitation serves as an energy absorber in and of itself.

In accordance with the present invention the aforementioned membrane members must be capable of absorbing high stress levels, should have a very low modulus of elasticity and low areal density.

In accordance with a further aspect of the present invention, the structural members of the vessel which support the membrane members have cooperating support members extending therebetween which are normally spaced from a first support member while supported from a second support member and which provide cooperative support between the two support members when the first support member is caused to deflect due to membrane deflection and engage the cooperating support member.

In accordance with the present invention, the single skin bottom plating of the vessel is fabricated of a plurality of membrane members which are of substantial area, and preferably equal areas, and which are supported throughout their periphery solely by a minimal of support structure.

In accordance with a further aspect of the present invention, the important vessel compartments, such as the crew's quarters and the engine room are supported from vessel structural members, such as bulkheads, by shock absorbing mounts only. In this fashion, any of the force of the underwater explosion which is not absorbed by membrane member deflection will be absorbed by the compartment mounts and not transmitted to the crew members and sensitive machinery.

In the present invention the membrane members are preferably glass reinforced plastic plates which are adhesively bonded to structural members throughout their periphery and which are cured in an autoclave so as to produce maximum strength and an aperture free bottom hull plating. The membrane plates could also be mechanically fastened to the structural members.

In accordance with the present invention, the energy of the shock wave generated by an underwater explosion which is not absorbed by hull deflection is not transmitted to the vessel's personnel and machinery since both personnel and machinery are housed in structures which are isolated from hull structural members by shock absorber mounts.

Figure 2:
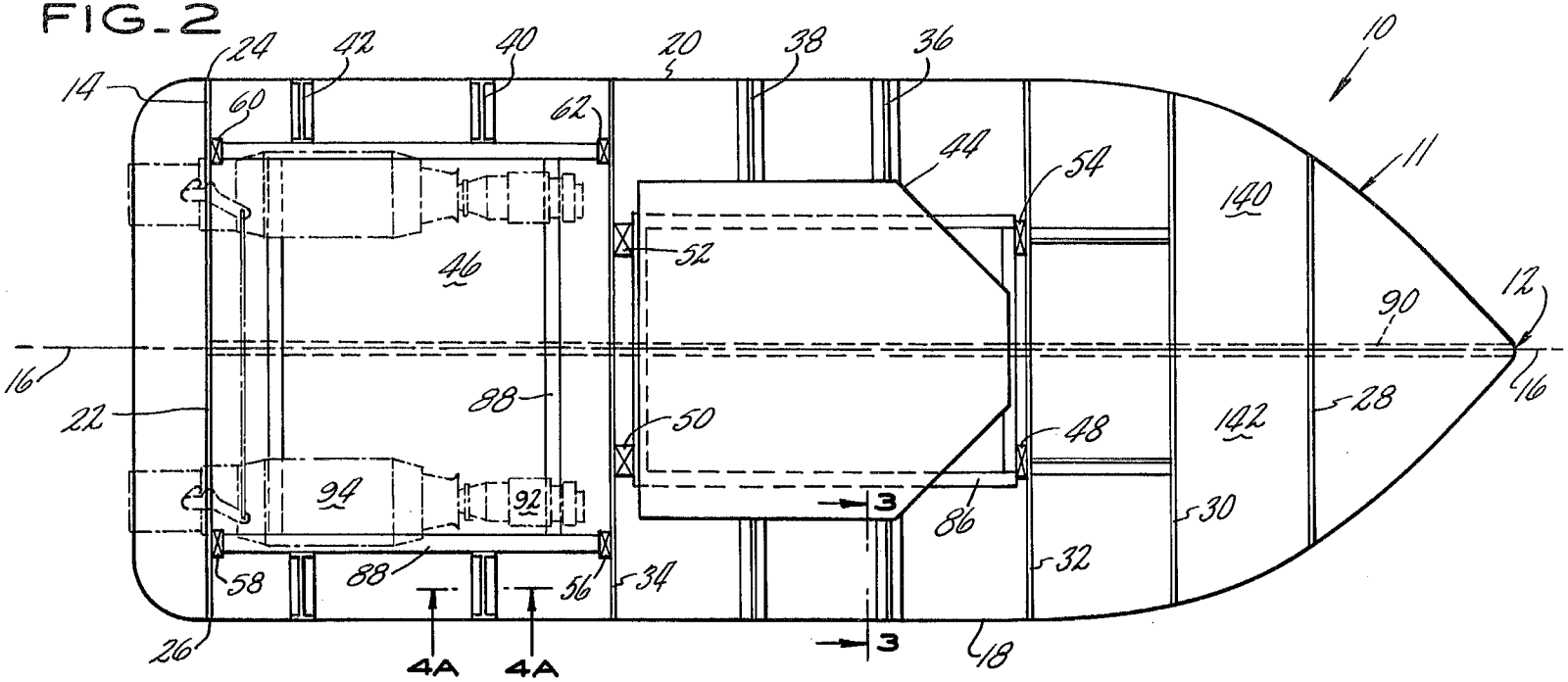
FIG. 2 is the top view of a vessel, partially broken away, to illustrate the details of the present invention.

FIG. **4*a* is an enlarged showing taken along line 4*a*—4*a* of FIG. 2**.

Figures 3, 4, 4A, 5:
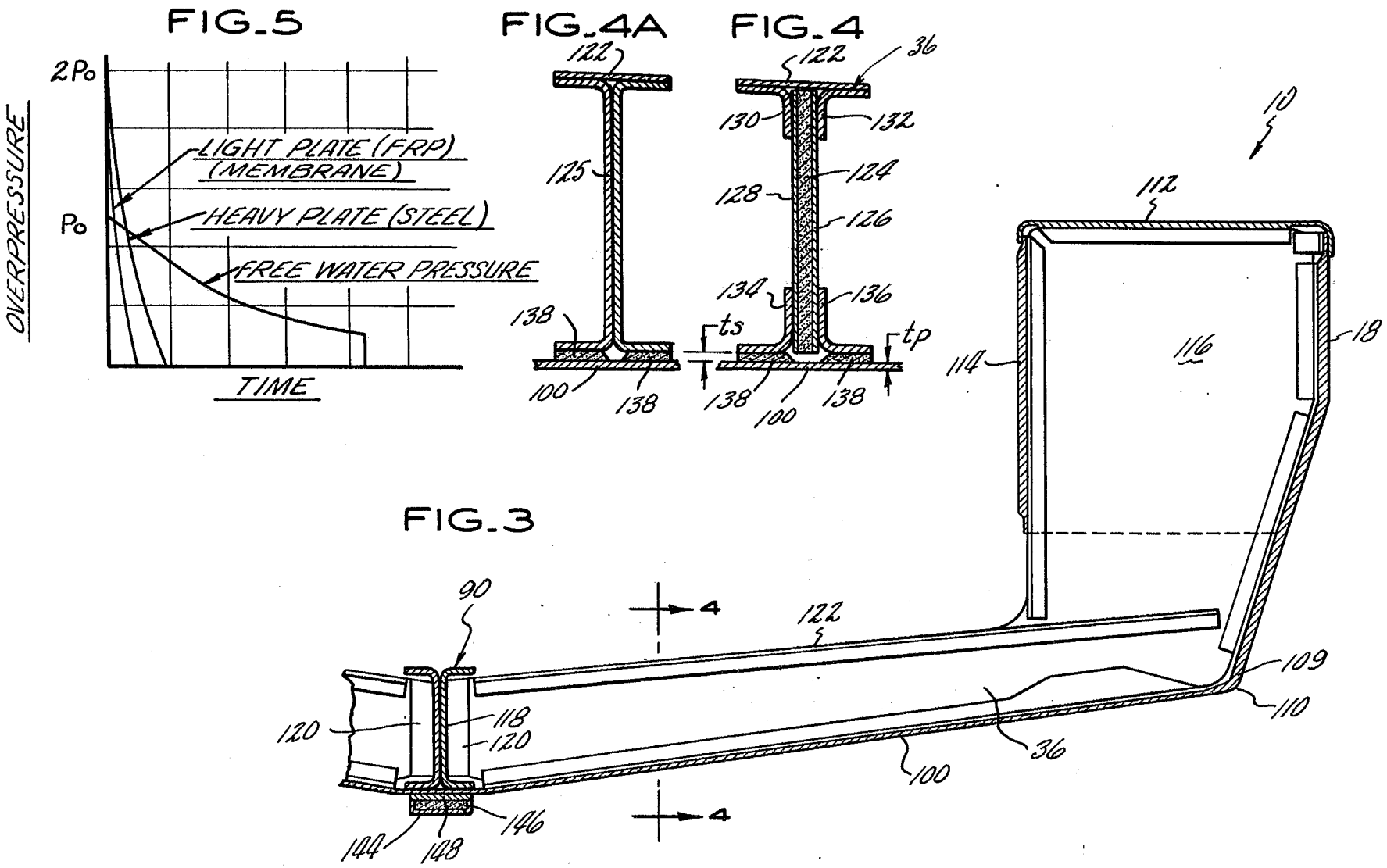
FIG. 3 is a cross-sectional showing through line 3—3 of FIG. 2.
FIG. 4 is an enlarged showing taken along line 4—4 of FIG. 3 illustrating the construction of a structural transverse frame and of the connection between the bottom plating and the structural members.

FIG. 5 is a graphic illustration of the blast pressure time history caused by an underwater explosion acting on the hull of a vessel.

Figure 6:
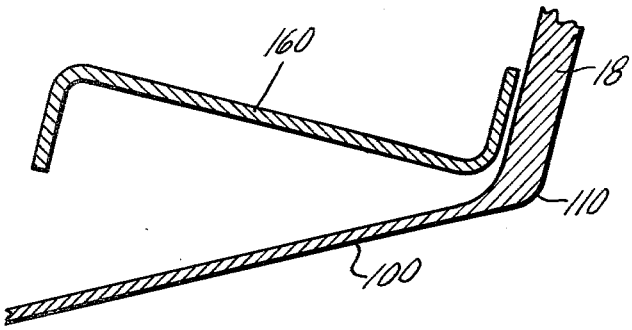

FIG. 6 is a showing of an inter-support member support which is responsive to bottom plating deflection to provide support to the structural portion of the bottom plating.

Figure 7:
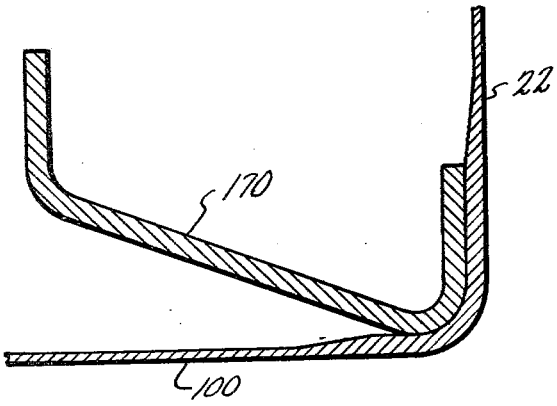

FIG. 7 is a showing of a support between the structural sideboards and the membrane members of the bottom plating.

Figure 8:
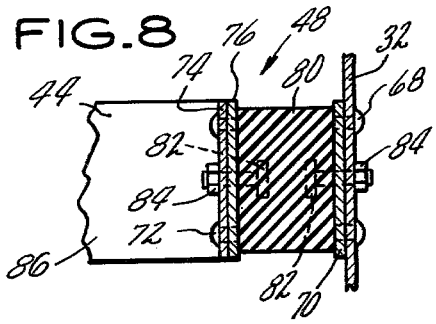

FIG. 8 is a shock absorbing support between vessel compartments and vessel structural members.

Figure 9:
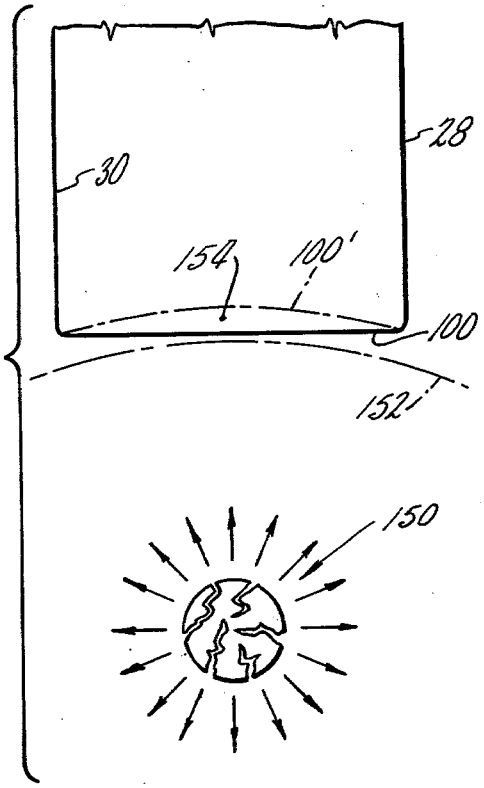

FIG. 9 is a schematic representation of the shock wave caused by an underwater explosion acting upon the membrane members of the vessel's bottom plating.

Figure 10:
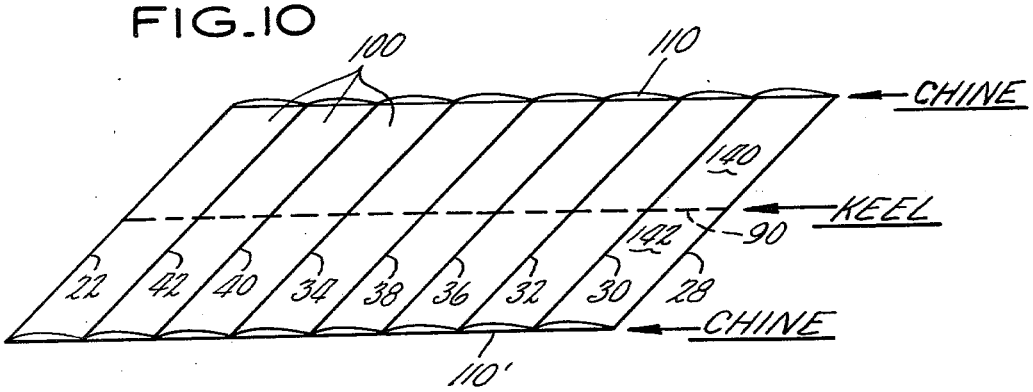

FIG. 10 is a showing of preferred membrane member construction.

Figure 11:
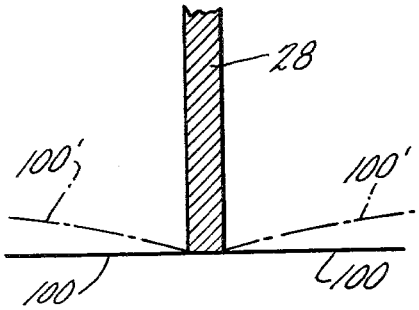

FIG. 11 is a showing of cancelling membrane deflection effects upon a structural members.

Figure 12:
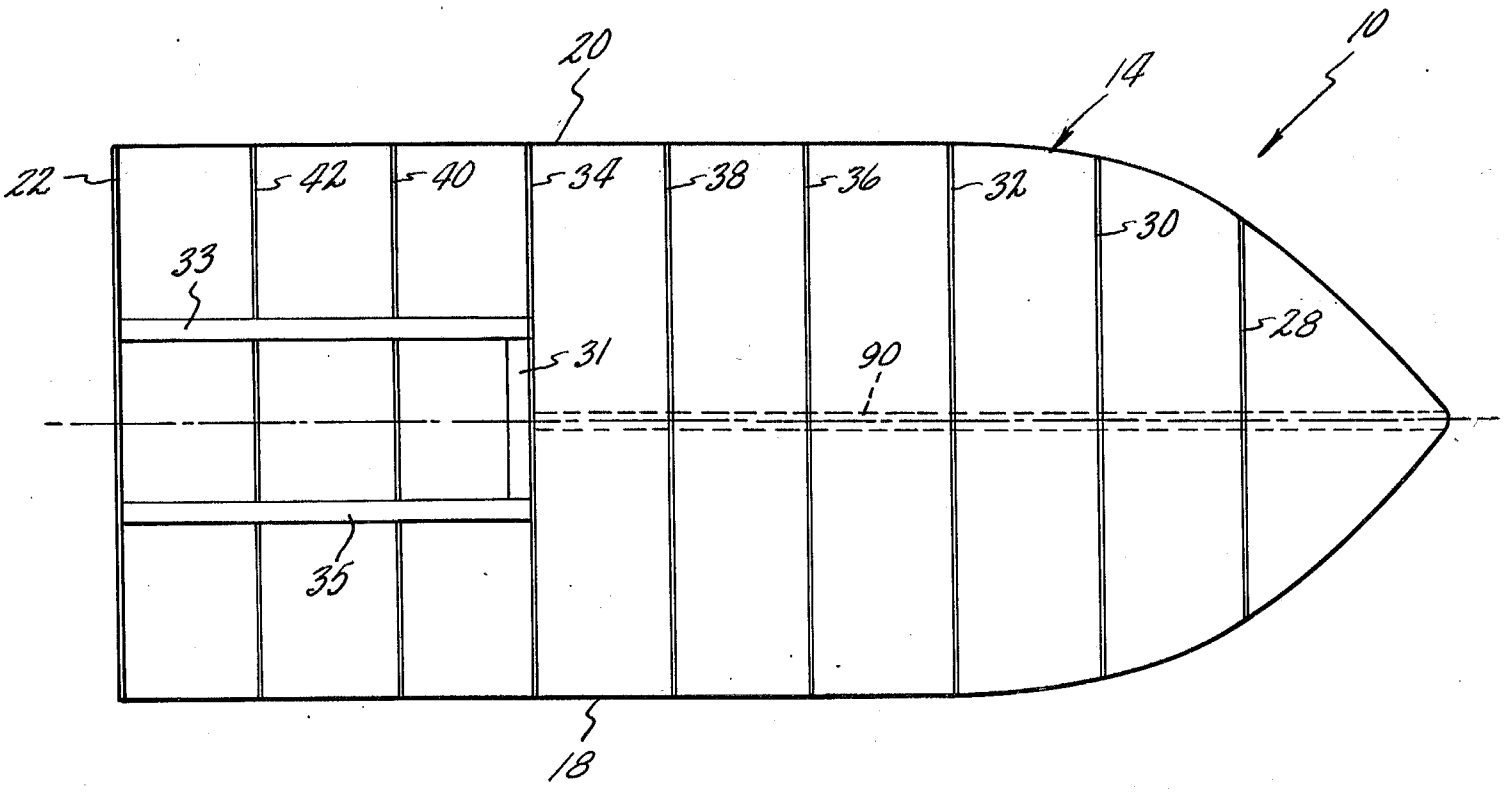

FIG. 12 is a plan view of an alternate form of framing.

DESCRIPTION OF THE PREFERRED EMBODIMENT

Figure 1:
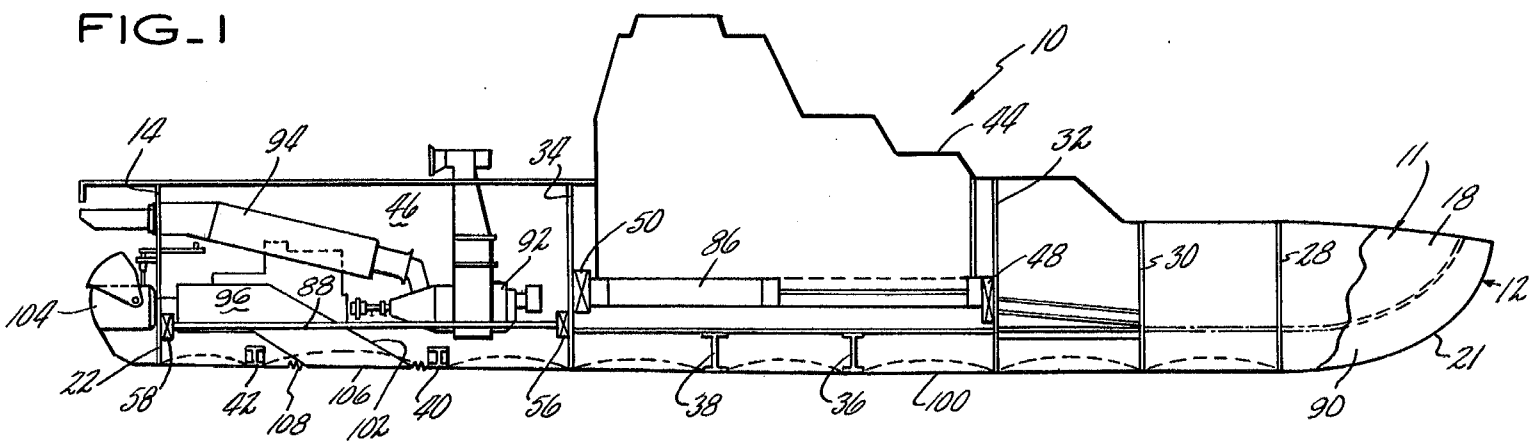
FIG. 1 is a side view of a vessel partially broken away utilizing the present invention.

Referring to FIGS. 1, 2 and 3, we see modern marine vessel 10 which is adopted for use in a war zone where underwater explosions caused by mines, exploding projectiles and the like are likely to be encountered. Vessel 10 has a hull 11, bow 12, a stern 14, and longitudinal centerline 16. Starboard sideboard 18 and port sideboard 20 are symmetric with respect to longitudinal centerline 16 and connect at the bow in a watertight joint 21 and are connected to transom member 22, which extends transversely across centerline 16, in watertight joints 24 and 26. Transverse bulkheads, such as 28, 30, 32 and 34, are spaced along longitudinal centerline 16 and extend transversely of the vessel between the port and starboard sideboards 20 and 18 and serve as vessel structural members. In addition to these bulkheads, transverse frames 36, 38, 40 and 42 are positioned along centerline 16 and extend between sideboards 18 and 20 and cooperate with the bulkheads as the transverse support members for the vessel. Due to the reduced height of transverse frames 36–42, integral compartment units, such as personnel compartment 44 and engine room compartment 46, can be positioned between the sideboards 18 and 20.

The term vessel, as used herein, is synonymous with ship, boat and other marine craft.

So as to protect the personnel in personnel compartment 44 and the machinery in engine room compartment 46 from injury or damage if the force of the shock wave of the underwater explosion is not absorbed by the hull, as described hereinafter, the personnel compartment 44 is supported from bulkheads 32 and 34 solely by shock absorbing mounts 48, 50, 52 and 54 and engine room compartment 46 is supported from bulkhead 34 and transom 22 solely by shock absorbing mounts 56, 58, 60 and 62. Shock absorbing mounts 48–62 may be of the type more fully disclosed in FIG. 8, which shows shock absorber 48 connected to bulkhead 32 and compartment 44 by any convenient means, such as bolt members 68, threadably engaging bulkhead 32 and mount plate 70 and bolt member 72 threadably engaging compartment plate 74 and mount plate 76. Rubber member 80 is bonded to plates 70 and 76, or may receive therein at least one stud member, such as 82, which is integrally connected to and projects through mount plates 32, 70, 74 and 76 and also receives at least one attachment member 84, contacting plates 32 and 74. Preferably, personnel compartment 44 is supported by framework system 86, and engine room compartment 46 is supported by framework system 88, to which mounts 48–62 attach.

Single skin bottom plating 100, which will be described in greater particularity hereinafter, extends between sideboards 18 and 20, bulkheads 28–34, and transverse frames 36–42, and keel member 90.

While FIG. 2 illustrates a two engine configuration in which keel or other appropriate longitudinal framing 90 extends from bow-to-stern on the longitudinal centerline of vessel 10, it should be borne in mind that for three engines and other installations, keel 90 could terminate short of transom 22 and be connected thereto by appropriate longitudinal framing. One such framing configuration is shown in FIG. 12, which is generally similar to FIG. 2 except that keel or longitudinal frame 90 terminates at bulkhead 34 and is joined thereby and by transverse frame 31 to longitudinal frames 33 and 35, which connect to transom 22.

Engine room compartment 46 includes at least one engine 92, which may be of the jet, gasoline or diesel engine type more fully described in U.S. Pat. Nos. 2,711,631 and 2,747,367, and which expels its exhaust gas to atmosphere through exhaust duct 94, and which is connected in driving relation to free turbine unit and pump 96 which scoops water through the bottom plating 100 through ducting 102 and discharges this water through vessel steering nozzles 104, so as to perform the function of propelling and steering the vessel.

It is an important teaching of this invention that the bottom plating 100, which must be flexible to absorb the energy of the shock wave of an underwater explosion, not adversely affect the engine room equipment during deflection and accordingly, the inlet 106 of duct 102 is connected to bottom plate 100 by a flexible ring diaphragm 108. Due to diaphragm 108, bottom plating 100 may move between its solid lines FIG. 1 position during normal operation to its phantom FIG. 1 position during deflection without imparting that motion to ducting 102 and engine 94 and related parts.

Referring to FIG. 3 we see a portion of the hull construction of vessel 10 in greater particularity. Sideboard 18 is shown connected to bottom plating 100 to form a watertight joint 109 at chine 110. FIG. 3 is intended to show in greater particularity the construction of a typical transverse frame 36, which extends from keel 90 to sideboard 18 and serves the same function as the other transverse frames 38–42 and bulkheads 28–34. Deck 112 projects transversely between the sideboards 18 and 20 and may be foreshortened as shown in FIG. 3 to permit the positioning of a compartment therewithin. Deck 112 can be supported either by bulkheads 28–34 or from frames 36–42 by sideboards 18 and 20 and longitudinally extending support members 114. In addition a small bulkhead member 116 may extend between frame 36, sideboard 18, deck 112 and support 114. Keel 90 preferably consists of I-beam member 118, which comprises a plurality of layers of glass reinforced plastic, and which connects to transverse frame 36 by elements 120 which are bonded or mechanically fastened to transverse frame 36 and keel 90. The keel further consists of grounding copper exterior strip 144, which envelopes a plank of segmented white oak 146 and which is adhesively bonded to bottom plate 100 through plate member 148. Transverse frame 36 extends between frame upper cap 122 and bottom plating 100. Keel 90 could be of any desired shape and construction that provides adequate bending stiffness and support.

As best shown in FIG. 4, transverse frame 36 is of sandwich construction including a core of end-grain balsa wood 124, with sideplates of a plurality of plies of glass reinforced plastic 126 and 128 adhering thereto. Angle members 130 and 132, which consist of a buildup of a plurality of plies of glass reinforced plastic connect frame 36 to upper cap 122 and corresponding angle members 134 and 136 connect the opposite end of frame 36 to bottom plating 100 through a substantial layer of polysulfide sealant 138, of thickness $t_s$. For plastic reinforced fiber glass, $t_s$ is preferably about $\frac{1}{4}''$.

Transverse frames 36–42 could be constructed as shown in FIG. 4 or as shown in FIG. 4*a*. The FIG. 4*a* frame is a solid laminate frame wherein bonded laminates or sheets of plastic reinforced fiber glass form I-beam member 125, which extends between and is connected to upper cap 122 and bottom skin 100.

As described hereinafter, plate 100 is a sheet of glass reinforced plastic of about $\frac{1}{4}''$ thickness to 3/16" thickness ($t_p$) which is adhesively bonded or mechanically fastened to sideboards 18 and 20, to bulkheads 28–34 and to transverse frames 36–40 and keel 90 so that bottom plating 100, which constitutes a plurality of membrane members, is aperture free for maximum watertight integrity. It will also be noted by viewing FIG. 2 that the sole framework to support these membrane members which constitute bottom plating 100 is defined by the keel 90, bulkheads 28–34, transverse frames 36–42 and sidewalls 18 and 20 and transom 22, and the membrane members are otherwise free to flex or deflect. Preferably, the bays, such as bay 140 and 142 (see FIG. 2), are of substantial area and each bay is preferably of substantial equal area with all other bays so that the amount of flexing of the membrane members 100 and hence the energy absorbed thereby is substantially equal so that the force of a shock wave caused by an underwater explosion will be attenuated equally throughout the vessel and not cause a more severe reaction or motion in one portion of the vessel than in another.

Sideboards 18 and 20 are constructed in the same fashion as are the transverse frames such as 36 and as illustrated in FIG. 4. As stated earlier, it is the primary object of this invention to provide a vessel which is capable of withstanding the force of underwater explosions without damage to the vessel, the vessel equipment, or the crew personnel and which includes a hull which is fully acceptable in service from a hydrodynamic standpoint, which is capable of withstanding the force of underwater explosions and of absorbing or attenuating the force of these explosions, and which is also capable of withstanding the force of debris collision which would be encountered in normal operation. In accomplishing this underwater explosion force absorbing or attenuating function, this invention, rather than utilizing the exterior armour or the extraordinarily thick plating of the prior art described supra utilizes a hull whose bottom plating is made up of a plurality of membrane members which are supported about their periphery only and which are of unusually large areas. As used herein, a membrane member defines a structural member which absorbs energy through deflection and tensile loading and without any bending loading. Such a member absorbs the energy of an underwater explosion by very rapid and very substantial deflections without taking a permanent set. These membrane members may be likened to a balloon skin or to a drum skin, which is highly flexible in and of itself and which is supported about its periphery only.

In investigating the best material to use as membrane members 100, tests were conducted on glass reinforced plastic, steel and aluminum. A high quality laminate of glass reinforced plastic was found to be the most desirable of these three materials tested since it is capable of absorbing high stress levels on the order of 50,000 psi, which is well above the standard small boat construction steel and has a very low modulus of elasticity; for example, the modulus of elasticity of glass reinforced plastic is one tenth that of steel and one third that of aluminum. The modulus of elasticity of glass reinforced plastic is approximately $3\times10^6$ psi.

The following chart illustrates the results of our study when glass reinforced plastic or fiberglass reinforced plastic was tested as membrane member 100 along with aluminum and steel for membrane members. The fiber glass reinforced plastic construction showed superior characteristics for reducing and absorbing the effects of a nearby underwater explosion. FIG. 5 graphically illustrates the pressure-time history of different plate masses exposed to an underwater shock. It can readily be seen that the lighter the plate (low areal density) the less impulse and energy imposed on it. The material chosen for the bottom plating 100 requires the ability to absorb a large quantity of energy without significant permanent set or rupturing.

This requirement demands a material with a low modulus of elasticity and high strength. Another desirable requirement for good dynamic characteristics in an underwater explosion environment is a low natural frequency structure to minimize the response.

MATERIALS COMPARISON
(SAME DESIGN USED FOR ALUMINUM & STEEL)
(FIBERGLASS DESIGN USED IS OUTLINED HEREIN)

| | STEEL | ALUMINUM | FIBER GLASS REINFORCED PLASTIC |
|---|---|---|---|
| WEIGHT COMPARISON WT. (LBS.) | 13920 | 5517 | 3340 |
| IMPULSE IMPARTED TO HULL BOTTOM PLATING LB-SEC/IN$^2$ | 0.1622 | .0744 | .0339 |
| EQUIVALENT STEP VELOCITY INPUT TO HULL BOTTOM PLATING Vo(FT/SEC) | 55.2 | 62.8 | 67.1 |
| EQUIVALENT STATIC RESPONSE PRESSURE ON HULL BOTTOM PLATING (PSI) | 109 | 60.5 | 12.3 |

As the comparison indicates, the use of fiber glass reinforced plastic results in a significant weight saving when compared to aluminum or steel. Steel and aluminum respond more violently to the blast impulse than the fiber glass design.

Our testing and experimenting showed that for optimum blast attenuation, the membrane members 100 should be of the largest possible area. However, this presents problems in ordinary use of the boat because the larger the membrane member, the greater deflection of the bottom plate due to static loading during normal operation. Such static deflection of the membrane members would produce a hull of irregular shape during normal operating and this would create undesirable drag. For this reason and for the additional reason of accommodating compartment size and other size requirements, maximum area membrane members are not always possible. All membrane members should be of substantially the same area so that the same amount of shock attenuation is accomplished over the entire hull of the vessel so that the vessel has the same reaction to the force of the shock wave caused by an underwater explosion. If, for example, the membrane areas in the bow of the vessel were considerably smaller than the membrane areas in the stern of the vessel, it would be expected that the bow of the vessel would be caused to rise in the water by an underwater explosion force more rapidly and to a greater degree than the stern of the vessel.

Early investigations showed that the membrane member concept was indeed capable of producing shock wave attenuation but it was necessary that this attenuation be substantial since it was imperative that not only the vessel be able to withstand the shock but that the crew members and delicate machinery aboard also be able to survive following the shock and that the crew reaction capabilities not be impaired.

To produce maximum shock wave attenuation, the phenomenon of areal density of the membrane was investigated. By areal density we mean the weight per square foot of the membrane member 100. The significance of areal density of the membrane member is that it determines the response time or rate of the membrane member to the shock wave established by the underwater explosion. This response rate was demonstrated to be very significant in the problem of shock wave attenuation because experiments showed that as the hull or membrane members 100 deflect in response to the underwater explosion shock wave, this deflection of the hull causes the water to try to follow the deflecting hull and imposes a tensile loading on the water, which water is incapable of withstanding and therefore the water is caused to cavitate or aerate. This cavitation of the water proves to be highly beneficial because the cavitated water in itself is a shock absorber.

As best shown in FIG. 5, under the test conditions, the free water pressure caused by the underwater explosion under consideration had a peak of $P_o$ psi, and while the reflection wave caused when the shock wave contacted the membrane member causes this pressure to rise to at least double that amount, the result of cavation of the water is to reduce the overall time the pressure pulse acts and therefore reduces the energy to be absorbed by the hull.

Considering FIG. 5, we see that the nature of the shock wave generated by an underwater explosion, which is responsible for at least part and probably a major part of the damage caused to the structure of the vessel by non-contact water explosions, results in a sudden rise in pressure at the vessel's hull to a maximum value shown in FIG. 5 to be $P_o$ psi. After reaching the peak value, the pressure immediately begins to decay. The decay time, for an underwater explosion at a given distance from the hull, is roughly given by an exponential expression in the form of:

$$P_t = P_o e^{-t/\theta} \qquad \text{Equation 1}$$

where $P_t$ is the pressure at time t and $P_o$ and $\theta$ are constants, the peak pressure and the time constant, respectively of the shock wave at a given distance. The rate of decay is commonly indicated by giving the value of $\theta$ which corresponds to the time required for the pressure to fall to $1 \div e$ of its original value, where e is the base of the natural logarithm. At a time behind the shock front corresponding to five times the time constant, the pressure has fallen to 5 or 10% of the peak value and thereafter decreases very slowly. At a time after the shock front equal to $8\theta$, the pressure has fallen to approximately 5% or less of the peak value.

Although the hull is subjected to these very high pressures, we will now show how, through this invention, the effective pressure on the hull is reduced to about 1% of the peak free water pressure. This can best be illustrated by examining FIG. 9 which depicts one of our membrane members 100 positioned between two bulkheads, such as 28 and 30, and positioned about the remainder of its periphery by sideboards 18 or 20 and keel 90 (not shown), and floating in water and being subjected to the shock wave from an underwater explosion at station 150. FIG. 9 can be likened to an explosion acting upon a piston, comparable to membrane 100, within a cylinder defined by the various framework elements including bulkheads 28 and 30.

As shock wave 152 caused by the underwater explosion impinges against membrane 100, due to the low areal density of the membrane, the membrane will rapidly deflect to the position shown in phantom as 100' and will cause a cavitation effect in the water in region 154 to serve as a shock absorber to the shock wave 152.

We now have our membrane 100 in motion and we can analogue the underlying principle by representing the energy of the shock wave being imparted to the membrane member by the following equation:

$$E = \tfrac{1}{2} MV^2 \qquad \text{Equation 2}$$

where M is the Mass and V is the Velocity of the membrane member 100. This represents the kinetic energy of the membrane member. This kinetic energy must be absorbed by the potential energy of the membrane member, which may be represented by the following equation:

$$E = (k\delta^2)/2 \qquad \text{Equation 3}$$

where K is the spring constant resulting from the strain energy capability of the membrane member, and $\delta$ is the final deflection of the membrane member.

Our testing showed that by this membrane deflection phenomena the force acting against the hull could be reduced from 2 $P_o$ psi to 0.005 $P_o$ psi static effective pressure. While this is a substantial gain, nonetheless the reduced pressure results in a very high accelerations and would have adverse effects upon the vessel's personnel.

Accordingly, to reduce the transmissibility of the energy of the underwater explosion which is not absorbed by the shock absorbing action of the membrane members 100, the crew's compartment 44 and other sensitive machinery compartments such as the engine room compartment 46 are supported from the hull by shock absorbers solely as shown in FIGS. 1 and 2, and 8.

Conventional vessel construction requires the fabrication of a rigid hull wherein a series of closely spaced stringers extend from the bow to the stern of the vessel and a series of closely spaced frame members extend laterally of the vessel at frequent stations. Contrary to this conventional vessel construction, the hull construction of the vessel taught herein is best illustrated in FIG. 1 and consists of a minimum number of frame members in the form of transverse bulkheads 28–32 and transverse frames 36–42, which cooperate with sideboards 18 and 20, keel 90, and transom 22 to define a plurality of apertures and bays, such as 140 and 142 of FIG. 2, across which the large area membrane members 100 extend to be supported solely thereby. For a 40 foot boat, these membrane members can be as large as 5'×10' and thereby, utilizing a minimum of framing and a maximum membrane area, a highly flexible and shock absorbing hull bottom is achieved.

Members 160 (FIG. 6) extend longitudinally and are attached at stations between bulkheads and frames to the vessel side members 18 and 20, approximately at the chine 110 between the boat bottom 100 and side members 18 and 20 and support the membrane members 100 when the membrane members deflect in response to the force of an underwater explosion.

Member 170 (FIG. 7) is similar to member 160 and extends transversely between side member 18 and 20 and is attached near the bottom of the transom (member 22) and supports the membrane member 100 when said membrane member deflects in response to the force of the underwater explosion.

As a membrane member deflects, edge loads or edge pull is supported by the Z section at the chine or channel section at the transom, and elsewhere as required.

The ideal bottom plate hull construction is shown in FIG. 10, wherein a plurality of membrane members 100 are positioned across apertures or bays 140 and 142 defined between chines 110 and 110', keel 90 and transverse frames or bulkheads such as 28–42, and transom 22. The advantage to be gained by this equal area membrane construction is that the force of the shock wave generated by the underwater explosion is attenuated equally throughout the hull of the vessel so that the vessel reacts thereto equally, rather than more severely at one section of the vessel than at another. In addition, as best illustrated in FIG. 11, equal area membrane members 100 place equal and cancelling buckling forces on the bulkheads or frames such as 28. The frame and bulkhead members 28–42 receive the same cancelling forces in a fore and aft direction.

From a materials standpoint, membrane members 100 are preferably made of glass reinforced plastic, known as GRP.

Bulkheads 28–34 and transverse frames 36–42, as well as sidewalls 18 and 20 are made of sandwich construction which includes glass reinforced plastic plates as the face members and with end grain balsa wood as the core member positioned within the plates and adhesively bonded to, as best illustrated in FIG. 4. Some of the transverse frames could be made of solid glass reinforced plastic construction, as is keel 90. The structural parts of the boat, such as the bulkheads, the transverse frames, the sideboards and the transom are mechanically connected to one another in any convenient fashion such as by conventional mechanical fasteners. To insure the watertight integrity of the hull and support, the bottom membrane members and the fiberglass hull members 100 are bonded to the structural frame members by a layer of polysulfide rubber. This bonding relates to the bottom skin plating 100 only.

The fabrication of vessel 10 will now be described.

The hull 11 is made in a male or female mold, as applicable, using preimpregnated fiberglass reinforced plastic material. Each hull segment is vacuum bagged and inserted in an autoclave under selected temperature and pressure. The autoclave is used to cure the laminate under pressure which drives the volatiles back into solution thereby eliminating any laminate void content. The autoclave temperature promotes the catalyst during the heat curing process. After the autoclave curing process the hull is assembled in a jig and bonded or mechanically fastened together. All internal structure, i.e, bulkheads, decks, keel, transverse frames, etc. are made in a similar manner. The internal structure is bonded and/or fastened to the hull after being cured in the autoclave.

I wish it to be understood that I do not desire to be limited to the exact details of construction shown and described for obvious modifications will occur to a person skilled in the art.

We claim:

1. A marine vessel having a hull with a capability of withstanding the force of underwater explosions and having a bow, a stern, a bottom, and a longitudinal centerline and including:

(A) side members having top and bottom edges and abutting at said bow to form a watertight joint and extending to the stern and positioned substantially symmetrically on opposite sides of the longitudinal centerline of of the ship, (B) a transom having top and bottom edges and located at the stern and extending transversally between and connected to the aft end of said side members to form a watertight joint therewith, (C) at least one longitudinal frame member extending along the longitudinal centerline of the ship between said bow and said stern and connected to the bottom edge of said side members at said bow and connected to the bottom edge of said transom, (D) a plurality of transversally extending support members extending between said longitudinal frame member and said side members, to form watertight joints and the chine therewith, and spaced along said longitudinal centerline to cooperate with said longitudinal frame member and said side members to define a plurality of bays in the boat bottom, and (E) a separate membrane member individual to each of said bays extending across and connected to the entire outer periphery thereof.

2. Apparatus according to claim 1 wherein said bays are of substantially equal area.

3. Apparatus according to claim 2 wherein said membrane member is a high strength, low modulus of elasticity, low areal density member.

4. Apparatus according to claim 3 wherein the tensile strength level of said membrane member is about 50,000 psi, wherein the modulus of elasticity of said membrane member is about $3\times10^6$ psi, and wherein the areal density of said membrane member is approximately $9\frac{1}{2}$ lbs./ft.$^2$ for a 1" thick laminate.

5. Apparatus according to claim 1 wherein said membrane member is fiber glass reinforced plastic of a thickness between $\frac{1}{4}$" and 3/16".

6. Apparatus according to claim 1 and including support members connected to the vessel side members approximately at the chine between the vessel side members and the vessel bottom and shaped to support both said side members and said transverse frames when said transverse frames and membrane members are caused to deflect due to pressure created by an underwater explosion.

7. Apparatus according to claim 1 and including support members connected to the vessel side members approximately at the chine between the vessel bottom and side members and in transverse alignment with said membrane members and shaped to support said membrane members when said membrane members deflect in response to the force of an underwater explosion.

8. Apparatus according to claim 1 and including a compartment unit positioned between two of said transversally extending support members and further including a plurality of vibration damping mounting means extending between said support members and said compartment unit and constituting the sole support for said compartment unit.

9. A marine vessel having a hull with a capability of withstanding the force of an underwater explosion and having a bow, a stern, a bottom, and a longitudinal centerline and including:

(A) sideboards having top and bottom edges and abutting at said bow to form a watertight joint and extending to said stern and positioned substantially symmetrically on opposite sides of the longitudinal centerline of the ship and fabricated of sandwich construction with end-grain balsa wood positioned between and bonded to sheets of fiber glass reinforced plastic on opposite sides thereof, (B) a transom having top and bottom edges and located at the stern and extending transversely between and connected to the after end of said side members to form watertight joints therewith, (C) at least one glass reinforced longitudinal frame member extending along the longitudinal centerline of the vessel between said bow and said stern and connected to the bottom edge of said side members at the bow and connected to the bottom edge of said transom, (D) a plurality of axially spaced bulkheads extending transversely between said sideboards and having a bottom edge substantially in alignment with the bottom edge of said sideboards and said longitudinal frame member, (E) a plurality of fiber glass reinforced plastic transverse frames extending transversely between and connected to said sideboards and positioned axially between said bulkheads and having bottom edges substantially in alignment with said bottom edges of said bulkheads so that said bottom edges of said bulkheads, said transverse frames and said longitudinal frame member define a plurality of apertures in the vessel bottom, and (F) single skin bottom plating comprising a plurality of membrane members individual to each aperture and each membrane member formed of a layer of fiber glass reinforced plastic and extending across and adhesively bonded throughout its entire periphery to the outer periphery of a corresponding aperture.

10. Apparatus according to claim 9 wherein said apertures are of substantially equal area.

11. Apparatus according to claim 10 wherein said single skin bottom plating is fiber glass reinforced plastic of a thickness of approximately between $\frac{1}{4}''$ and 3/16".

12. Apparatus according to claim 11 and including a compartment unit positioned between two of said bulkheads and further including vibration damping and shock absorbing mount means extending between said bulkheads and said compartment unit and constituting the sole support for said compartment unit.

13. Apparatus according to claim 12 and including support members connected to the vessel sideboards approximately at the chine and shaped to support said sideboards and said transverse frames when said transverse frames and single skin bottom plating are caused to deflect due to pressure created by an underwater explosion.

14. Apparatus according to claim 13 and including a support member connected to said vessel sideboards approximately at the chine and located in transverse alignment with said bottom plating and shaped to support said bottom plating when said bottom plating is caused to deflect due to the pressure created by an underwater explosion.

15. Apparatus according to claim 12 wherein said support members are of Z-shaped cross-section.

16. Apparatus according to claim 14 and further including support members connected to said transom and shaped to support said transom against deflection due to forces imparted thereto when said bottom plating is caused to deflect due to the pressure created by an underwater explosion.

17. A marine vessel adapted to withstand underwater explosions and including a bow, a stern, a bottom, and a longitudinal center line and having:

(a) sideboards joined as a watertight joint at said bow and extending toward and culminating at said stern and being symmetrical with respect to said longitudinal center line, (b) a transom extending transversely of said center line and joining the afterend of said sideboards in watertight joints, (c) at least one longitudinal frame member extending along the bottom of said vessel, (d) transverse support members spaced along said longitudinal center line and extending transversely thereto between said sideboards and cooperating with said longitudinal frame member and said sideboards to form a plurality of bays to constitute the structural portion of the vessel bottom, (e) and a membrane member of low areal density extending across each bay and adhesively bonded at its outer periphery to said longitudinal frame member, transverse members and sideboards and constituting a single skin bottom plating and being of selected material so as to absorb the energy of a substantial portion of the shock wave generated by an underwater explosion by reacting thereto rapidly in a substantial deflection without taking a permanent set position.

* * * * *